US007160023B2

(12) United States Patent
Freude et al.

(10) Patent No.: US 7,160,023 B2
(45) Date of Patent: Jan. 9, 2007

(54) SYSTEM FOR DETACHABLY COUPLING A DRIVE TO A MIXER MOUNTED IN A PORTABLE TANK

(75) Inventors: Paul E. Freude, Kenosha, WI (US); Richard D. Kramer, Racine, WI (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 179 days.

(21) Appl. No.: 10/809,210

(22) Filed: Mar. 25, 2004

(65) Prior Publication Data

US 2005/0213428 A1 Sep. 29, 2005

(51) Int. Cl.
*B01F 13/08* (2006.01)

(52) U.S. Cl. ..... 366/273

(58) Field of Classification Search ..... 366/273–274, 366/331, 199, 314, 349, 197–205, 207; 403/DIG. 1; 464/29; 416/3

See application file for complete search history.

(56) References Cited

U.S. PATENT DOCUMENTS

| | | | | | |
|---|---|---|---|---|---|
| 3,643,120 | A * | 2/1972 | Young et al. | ..... | 464/29 |
| 4,209,259 | A * | 6/1980 | Rains et al. | ..... | 366/273 |
| 4,781,468 | A * | 11/1988 | Herfeld | ..... | 366/213 |
| 4,993,841 | A * | 2/1991 | Lofgren et al. | ..... | 366/331 |
| 5,364,184 | A * | 11/1994 | Rains | ..... | 366/205 |
| 5,378,062 | A * | 1/1995 | Rains | ..... | 366/273 |
| 5,470,152 | A * | 11/1995 | Rains | ..... | 366/273 |
| 5,478,149 | A * | 12/1995 | Quigg | ..... | 366/314 |
| 5,516,207 | A * | 5/1996 | Haicht | ..... | 366/213 |
| 5,779,359 | A * | 7/1998 | Gambrill et al. | ..... | 366/273 |
| 5,865,538 | A * | 2/1999 | Walker et al. | ..... | 366/197 |
| 6,065,865 | A * | 5/2000 | Eyraud et al. | ..... | 366/314 |
| 6,206,562 | B1 * | 3/2001 | Eyraud et al. | ..... | 366/273 |
| 6,331,070 | B1 * | 12/2001 | Desai | ..... | 366/197 |
| 2004/0076076 | A1 * | 4/2004 | Hoobyar et al. | ..... | 366/273 |
| 2005/0213428 | A1 * | 9/2005 | Freude et al. | ..... | 366/273 |

FOREIGN PATENT DOCUMENTS

| | | | |
|---|---|---|---|
| JP | 11-333276 | * | 12/1999 |
| JP | 2002-58979 | * | 2/2005 |

OTHER PUBLICATIONS

Lightnin® MagMixer MB1, 6 pp; Lightnin, Rochester, New York. N A—mixer®, 8 pp; NovAseptic, Nodinge, Sweden, Feb. 2004.

* cited by examiner

*Primary Examiner*—Charles E. Cooley
(74) *Attorney, Agent, or Firm*—RatnerPrestia

(57) ABSTRACT

A system for detachably coupling a mixer drive to a mixer in a portable tank, the system comprising a portable tank having a mixer mounted therein and a docking station adapted to receive the tank in an engaged configuration and to have no connection to the tank in a disengaged configuration. The mixer comprises a coupling, such as a magnetic coupling, having a first portion attached to a shaft for driving the mixer, and the docking station comprises a mixer drive having a second portion of the coupling for mating with the first portion. The tank may have one or more components for facilitating and/or maintaining engagement of the tank with the docking station. The docking station may comprise a linkage for converting engagement motion transmitted by the tank in a first direction into engagement motion of the coupling second portion in a second direction.

43 Claims, 5 Drawing Sheets

SYSTEM FOR DETACHABLY COUPLING A DRIVE TO A MIXER MOUNTED IN A PORTABLE TANK

FIELD OF THE INVENTION

This invention relates to tank mixing systems, more particularly mixing systems for use with portable tanks.

BACKGROUND OF THE INVENTION

Many batch chemical processes, such as for example in the pharmaceutical industry, require mixing in certain stages of processing, and may use individual portable tanks for moving batches of in-process material through the process line. In some processes, the portable tanks may comprise a bottom-mount, magnetically driven mixer. Each mixer typically has a dedicated drive motor mounted on the tank. For any number of reasons, however, it may be desired not to permanently mount the drive motor directly on the tank, but rather to provide a system in which the drive motor may be routinely decoupled from the tank.

SUMMARY OF THE INVENTION

One aspect of the invention comprises a system for detachably coupling a mixer drive to a mixer in a portable tank. The system comprises a portable tank having a mixer mounted in the tank and a docking station adapted to receive the portable tank in an engaged configuration and to have no connection to the tank guide or the portable tank in a disengaged configuration. The mixer comprising a coupling, such as but not limited to a magnetic coupling, having a first portion attached to a shaft for driving the mixer, and the docking station comprises a mixer drive having a second portion of the coupling for mating with the first portion.

The portable tank may comprise a pair of guide rails on the portable tank for facilitating engagement of portable tank with a docking station, the pair of guide rails having a configuration relative to one another at a forward end of the guide rails to facilitate receipt of an extension of the docking station. The docking station may comprise a linkage for converting engagement motion transmitted by the tank in a first direction into engagement motion of the coupling second portion in a second direction. The system may also comprises a latch mechanism for preventing relative motion between the portable tank and the docking station with the system in the engaged configuration, the docking station comprising a first portion of the latch mechanism, the portable tank comprising a second portion of the latch mechanism for mating with the first portion, and the latch mechanism comprising a release mechanism for disengaging the latch mechanism. In one embodiment, the system may comprise all of the above features.

Another aspect of the invention is a docking station component of a system for detachably coupling a mixer drive to a mixer in a portable tank, as described above, the docking station comprising a mixer drive having a second portion of a coupling for mating with the first portion of the coupling attached to the shaft for driving the mixer on the portable tank.

Yet another aspect of the invention is a tank guide component for attaching to a portable tank for use with a docking station as described above, the tank guide component comprising a support frame for connection to the portable tank and one or more components for facilitating and/or maintaining engagement of the portable tank with the docking station.

Still another aspect of the invention is a portable tank having a mixer mounted in the tank, the mixer comprising a coupling having a first portion attached to a shaft for driving the mixer, the tank adapted for docking with a docking station in an engaged configuration and to have no connection to the portable tank in a disengaged configuration, the docking station comprising a mixer drive comprising a second portion of the coupling that mates with the first part of the coupling. The portable tank comprises one or more components for facilitating and/or maintaining engagement of the portable tank with the docking station.

A further aspect of the invention comprises a batch manufacturing process for manufacturing a composition. The process comprises providing one or more portable tanks, each tank having a mixer mounted in the tank, each mixer comprising a coupling having a first portion attached to a shaft for driving the mixer, and providing at least one docking station adapted to receive the plurality of portable tanks in an engaged configuration and to have no connection to the tank guide or the portable tank in a disengaged configuration, the docking station comprising a mixer drive having a second portion of the coupling for mating with the first portion. Manufacturing a batch of the composition or an intermediate ingredient required for making the composition in each of the portable tanks comprises performing one or more mixing steps by moving the portable tank to and engaging the tank with the docking station, connecting the first and second portions of the mixer coupling together, and driving the mixer in the portable tank using the mixer drive on the docking station.

DETAILED DESCRIPTION OF THE INVENTION

Figure 1A:
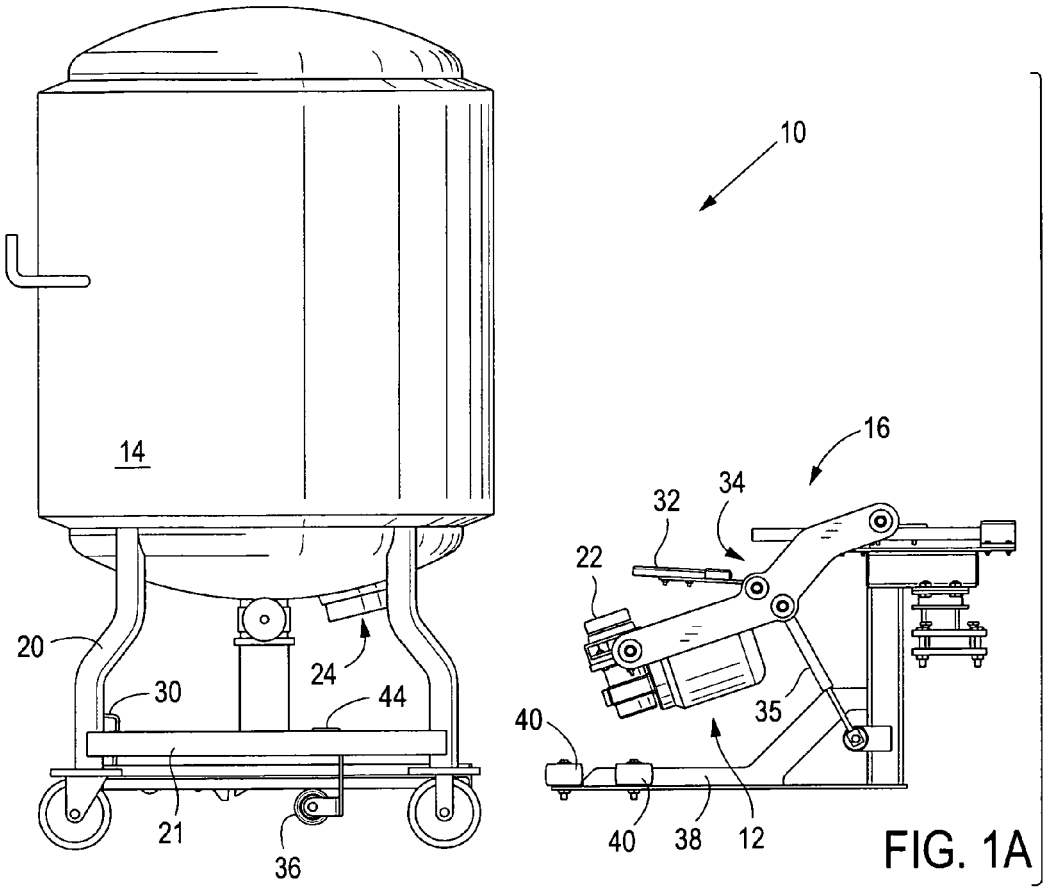
FIG. 1A is a side view of one embodiment of the present invention, showing a portable tank having an attached tank guide approaching a mixer motor docking station.

The invention will next be described with respect to the figures. FIGS. 1A–6B show an exemplary embodiment of a docking station and tank guide system 10 for detachably coupling a drive assembly 12 to a magnetically driven, bottom-mount, submerged mixer (not shown), mounted on a portable tank 14. The mixer may be any type of mixer known in the art, including but not limited to mixers made by Lightnin (for example, model MBI-410) of Rochester, N.Y.; Novaseptic AB of Nödinge, Sweden; Asepco of Mountain View, Calif., APV Steridose of Unna, Germany; and APCO Technologies, Inc. (for example, model A-1000) of Troutdale, Oreg. It should be emphasized that these are merely examples of some mixer designs suitable for use with the invention, but that the invention is not limited in any way to mixers manufactured by particular manufacturers, mixers having particular coupling designs, or even mixers having particular mounting locations.

The system comprises a docking station 16 that may be mounted on a freestanding frame (not shown) or to a wall (not shown), and a tank guide 18 that is mounted to the undercarriage 20 of the portable tank. A user moves portable tank 14, outfitted with tank guide 18, to docking station 16 and pushes the tank against the docking station until drive magnet 22 of drive 12 on the docking station engages drive magnet receiving hub 24 on the tank and tongue 25 of latch 26 on the tank guide engages latch receiving port 28 on the docking station. After the mixing step is complete, latch 26 is disengaged from port 28 by depressing latch release pedal 30, allowing the tank to be moved away from the docking station.

Figure 1B:
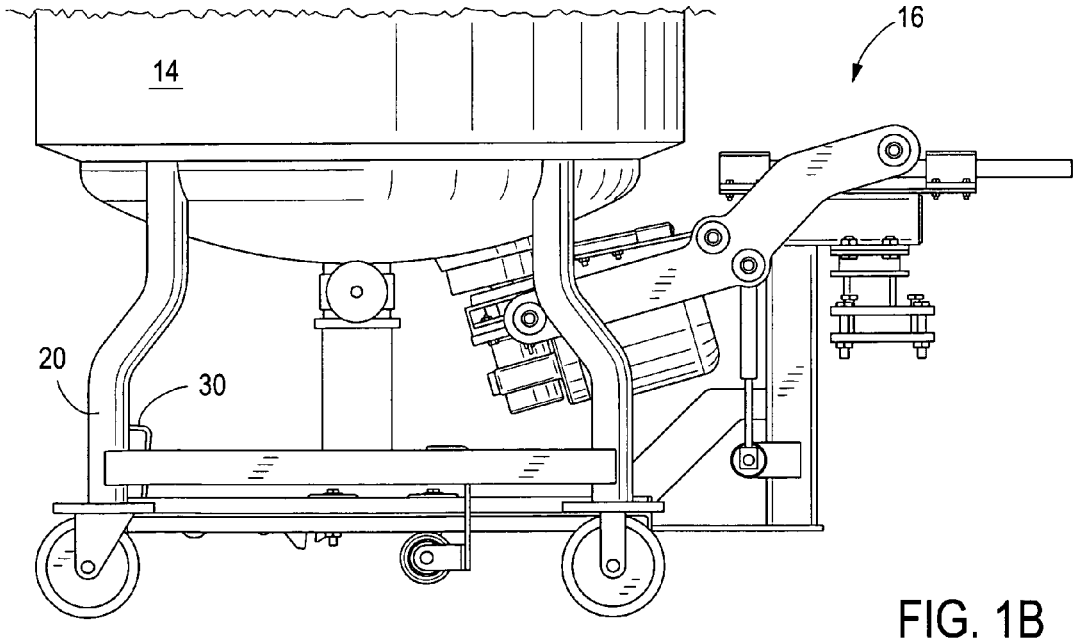
FIG. 1B is a side view of the embodiment shown in FIG. 1A with the portable tank and tank guide engaged by the docking station.
Figure 2:
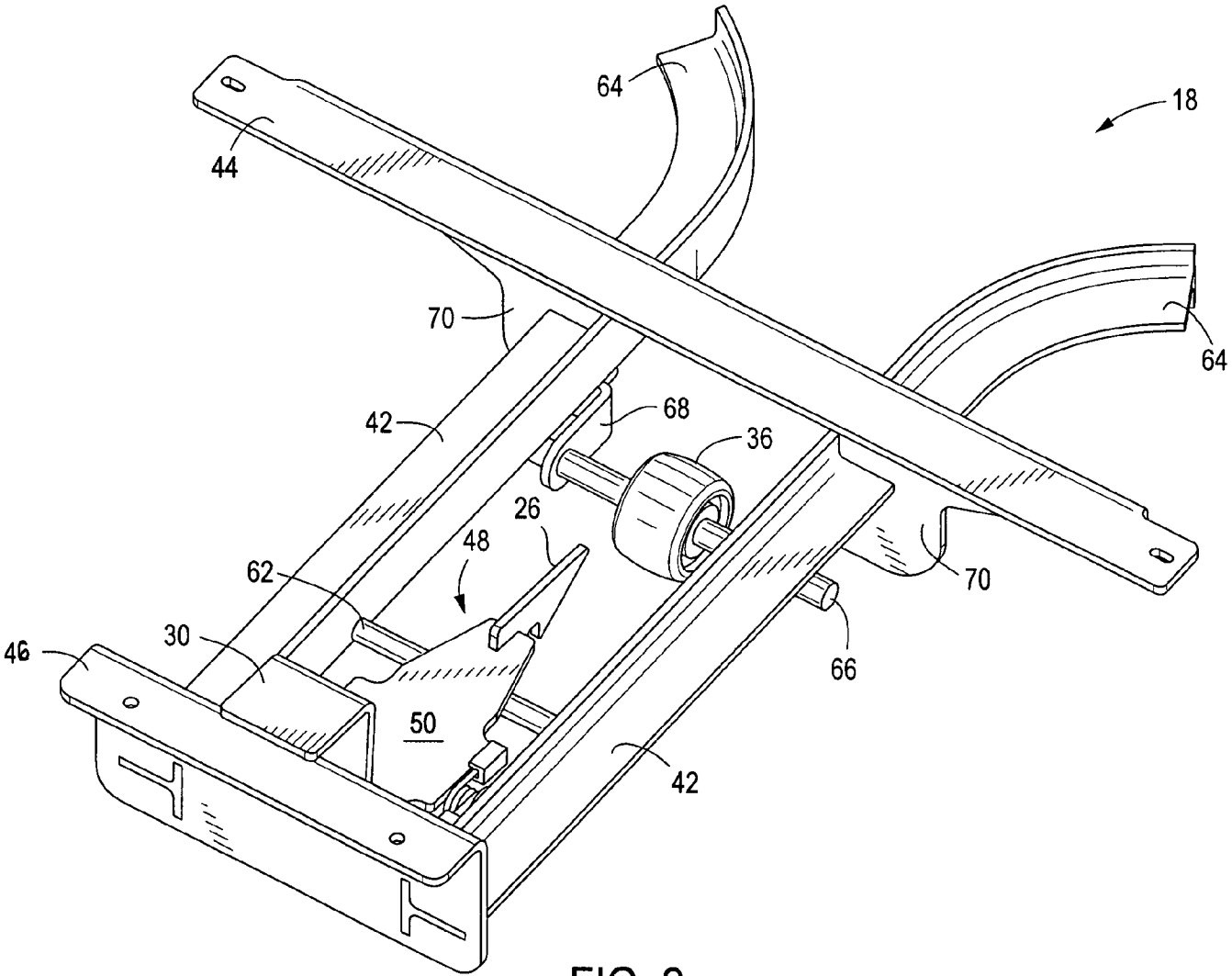
FIG. 2 is a perspective view of the exemplary tank guide shown in FIGS. 1A and 1B.
Figure 3:
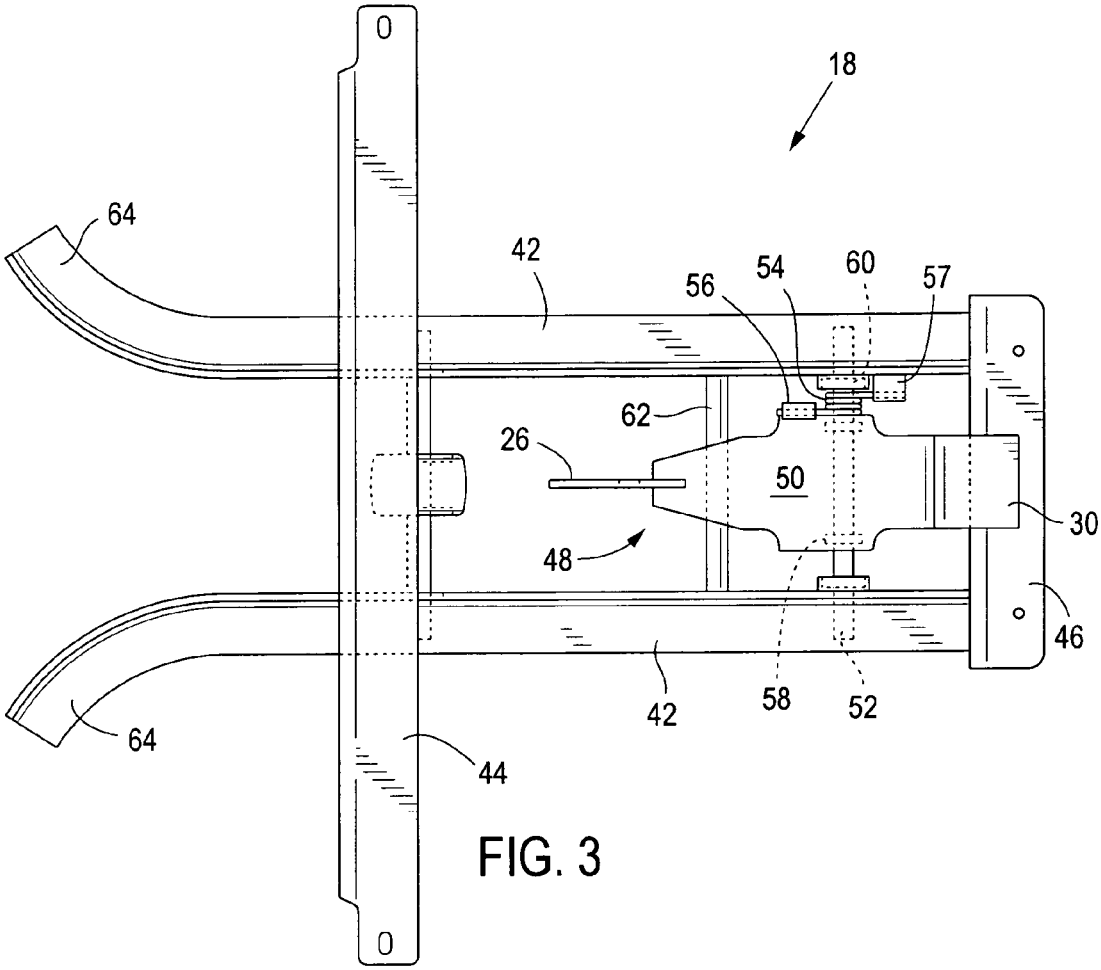
FIG. 3 is a top view of the tank guide of FIG. 2.
Figure 4:
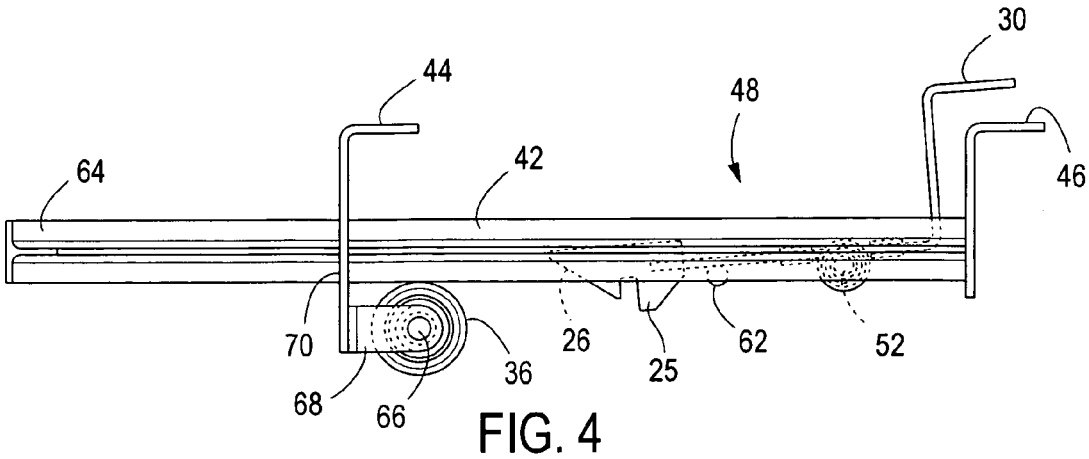
FIG. 4 is a side view of the tank guide of FIG. 2.
Figure 5:
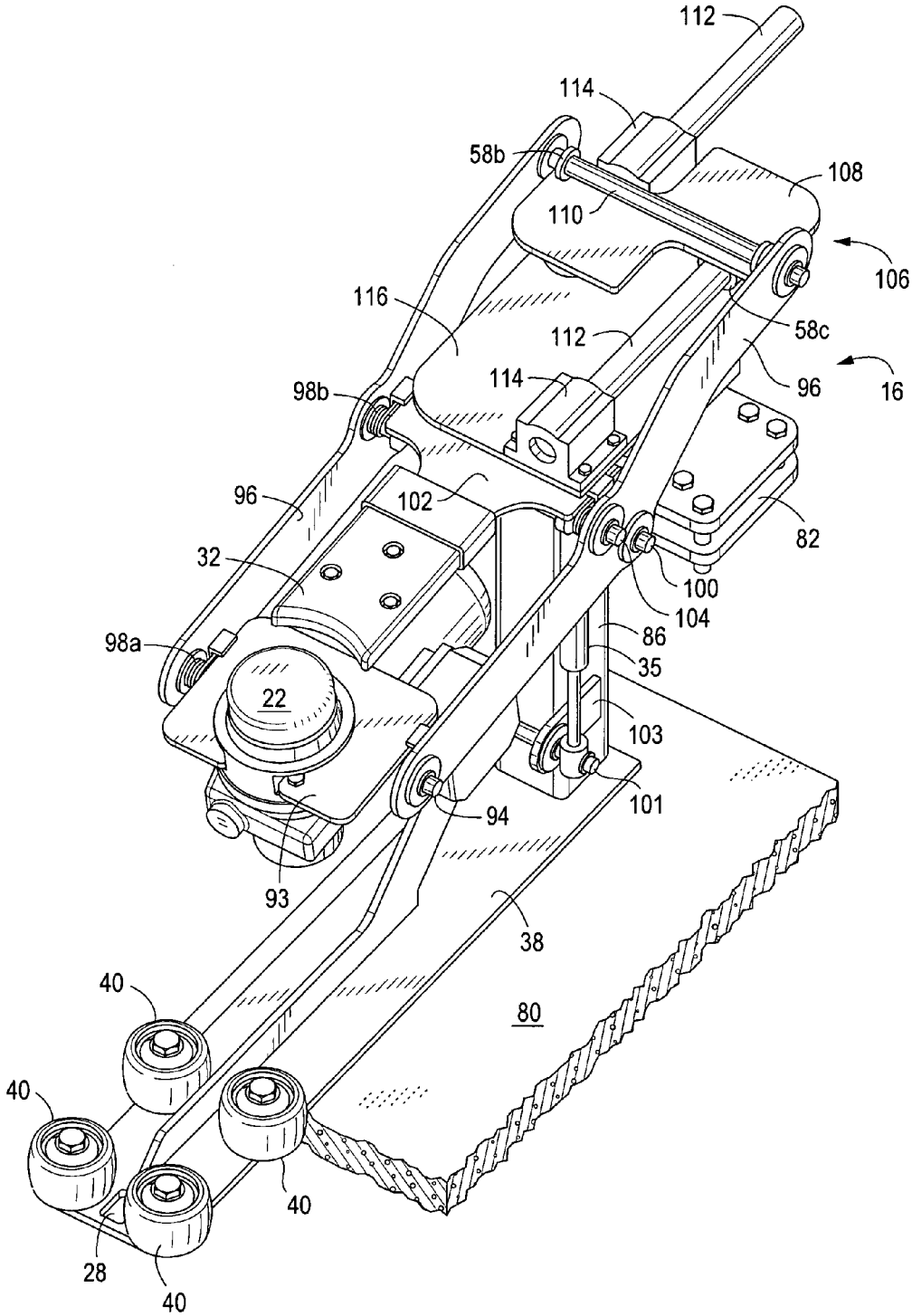
FIG. 5 is a perspective view of the exemplary mixer motor docking station of FIGS. 1A and 1B.
Figure 6B:
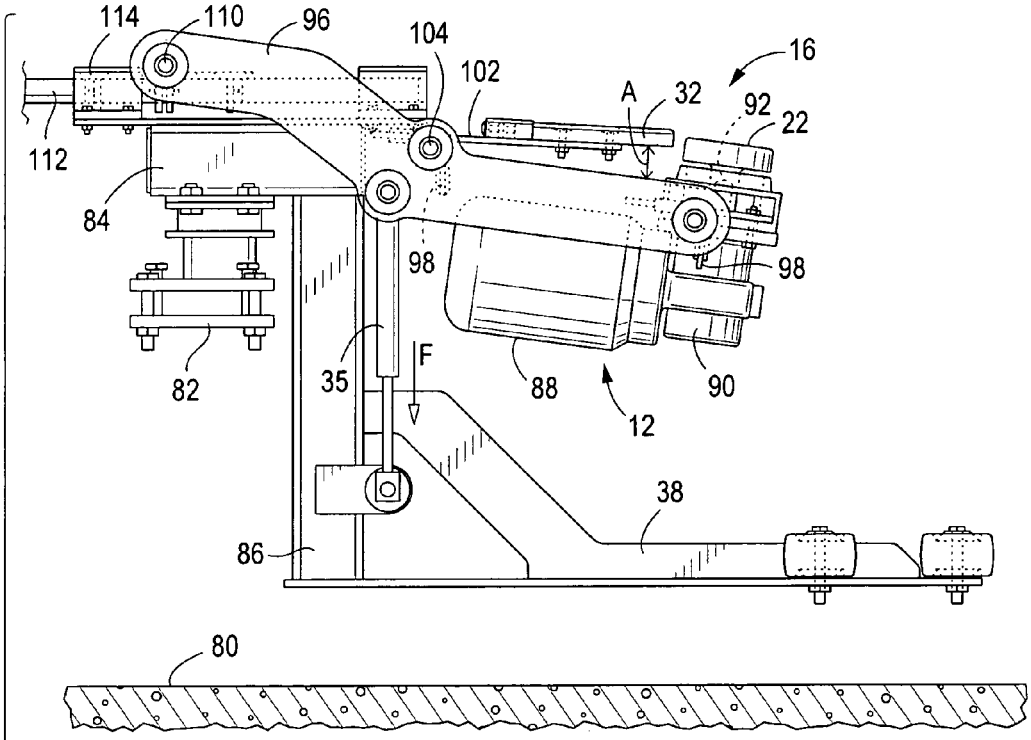
FIG. 6B is a side view of the docking station of FIG. 5, shown in the engaged configuration.
Figure 6A:
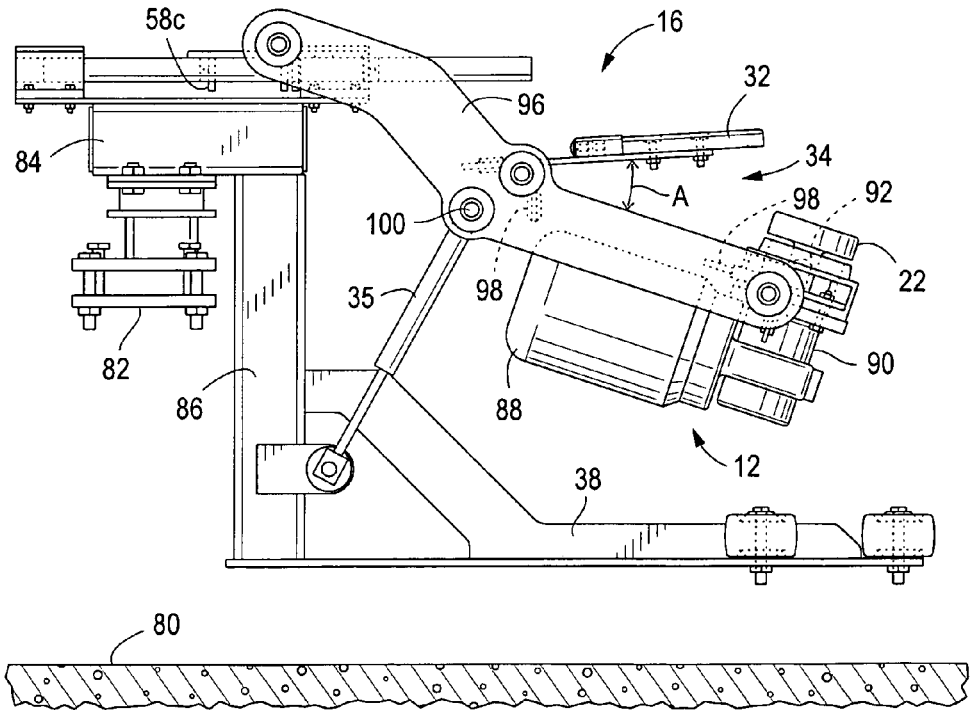
FIG. 6A is a side view of the docking station of FIG. 5, shown in the disengaged configuration.

Docking station 16 has a disengaged configuration shown in FIGS. 1A and 6A and an engaged configuration shown in FIGS. 1B and 6B. The docking station rests in the disengaged configuration until the tank is rolled into contact with the docking station. Drive magnet receiving hub 24 makes contact with hub-engaging member 32 and forces drive mount linkage 34 to move from the disengaged configuration shown in FIGS. 1A and 6A to the engaged configuration shown in FIGS. 1B and 6B, against the resistance of dual gas springs 35. In moving from the disengaged to the engaged configuration, tank guide wheel 36 makes contact with and rolls along the underside of docking station bottom plate 38 while docking station wheels 40 make contact with and roll between tank guide rails 42.

With the general overview above in mind, each portion of the exemplary embodiment will now be described in detail. Tank guide 18 comprises a frame defined by guide rails 42, front bracket 44, and rear bracket 46. The tank guide may be attached to the undercarriage 20 of portable tank 14 in any way known in the art, but in the embodiment depicted herein, rear bracket 46 is bolted to a rear crosspiece (not shown) on the undercarriage and front bracket 44 is bolted across side braces 21 of the undercarriage, as shown in FIGS. 1A and 1B. Leading portions 64 of guide rails 42 are flared outward relative to one another to provide a wide area to receive and guide docking station bottom plate 38. Tank guide wheel 36 is mounted to the guide rail frame via shaft 66 and mounting brackets 68 fixed to extensions 70 of front bracket 44.

Latch assembly 48 comprises latch 26 and latch release pedal 30 at opposite ends of latch plate 50. Latch plate 50 pivots on latch pivot shaft 52 and is spring biased by latch torsion spring 54, one end of which is attached to latch plate 50 with torsion clip 56 and the other end of which is attached to side bracket 42 with torsion clip 57. Pivot shaft 52 is pivotably fixed to latch plate 50 with rod holders 58 and to side brackets 42 with bearings 60. Stop rod 62 acts as a rotation stop for the lower range of motion of latch plate 50 induced by spring 54 and as a linear stop for the tank guide 18 against the front docking station wheels 40. Although depicted with the latch assembly 48 including tongue 25 mounted on the tank guide and the receiving port 28 on the docking station, the relative positions of these components may be reversed. Similarly, the latch assembly may comprise the port, and a fixed tongue may be attached to the mating component.

Docking station 16 comprises a plurality of elements suspended above floor 80, typically by affixing mounting plate 82 to a freestanding floor-mounted or wall-mounted structure (not shown for clearer visibility of the functional elements). Docking station 16 comprises horizontal support beam 84 connected to mounting plate 82 and to a vertical support beam 86. Bottom plate 38 extends outwardly from vertical support beam 86.

Drive assembly 12 typically comprises motor 88, gearbox 90 and drive shaft 92 on which drive magnet 22 is mounted, as are well known in the art. The particular configuration depicted in the drawings resembles a unit adapted to work with a LIGHTNIN® MBI-410 submerged, bottom-mount, magnetic-drive mixer, but the drive assembly may comprise any components necessary for use with any type of mixer known in the art. Although depicted for use with a bottom-mount mixer, similar docking station arrangements may be devised for use with side-entry or top-entry mixers. Similarly, although a magnetic drive is a preferred quick connecting mechanism for coupling the drive to the mixer shaft, other connection mechanisms (preferably ones designed for quick connection and disconnection) known in the art may be used.

Drive assembly 12 is attached at one end of drive mount linkage 34. Assembly 12 is attached to a drive support plate 93, which is mounted on drive pivot shaft 94 that is mounted between linkage arms 96. Torsion springs 98*a* are mounted on shaft 94 and attached to the drive support plate 93 at one end and to the linkage arms 96 at the other end using torsion clips (not shown) in a similar fashion as described above for the latch plate on the tank guide. Similarly, shaft 94 may be mounted between linkage arms 96 on bearings (not shown) as described above for the latch shaft. All of the torsion springs and shafts described herein may be installed in this manner.

Drive mount linkage 34 comprises arms 96, gas springs 35, hub engaging member 32, and slider assembly 106. Each gas spring 35 is attached at one end to upper springs pivot shaft 100 mounted between arms 96 and at the opposite end to lower springs pivot shaft 101 mounted between mounting brackets 103 attached to vertical support beam 86. Hub engaging member 32 is attached to hub engaging member support plate 102, which is mounted to hub engaging member pivot shaft 104 between arms 96. Torsion springs 98*b* are mounted on hub engaging member pivot shaft 104 and attached to hub engaging member support plate 102 at one end and to the linkage arms 96 at the other end. Slider assembly 106 comprises a slider plate 108 attached to a slider pivot shaft 110 with rod holders 58*b*, and a pair of slider shafts 112 attached to the slider plate with shaft holders 58*c*. Shafts 112 slide within linear bearings 114 mounted to bearing support plate 116.

As described above, portable tank 14 mounted on tank guide 18 is rolled into position onto docking station 16 so that hub engaging member 32 on the docking station contacts drive magnet receiving hub 24 on the portable tank. As the tank continues to be pushed into the docking station, the slider shafts 112 move backward within the linear bearings until the slider plate stops against the linear bearing structures. At the same time, linkage arms 96 pivot about slider pivot shaft 110, causing drive magnet 22 to be thrust upwardly into the receiving hub 24. To facilitate mating drive magnet 22 with receiving hub 24, the receiving hub may comprise a funnel-shaped modification attached to the standard flange associated with the portion of the mixer coupling attached to the portable tank. As the linkage arms pivot, the hub engaging member support plate 102 pivots on shaft 104 against the resistance of torsion spring 98, closing angle A between member 32 and arms 96.

Thus, linkage 34 translates the lateral motion of the tank toward the docking station into upward motion of drive magnet 22 into the drive magnet receiving hub 24 on tank 14. In the engaged configuration and in the transition from the disengaged to the engaged configurations, linkage 34 transmits a resultant downward force F on spring members 35, which is further transmitted to vertical support beam 86, which is essentially cantilevered off of mounting plate 82. To minimize the extent of the stress on the connection at mounting plate 82 that would otherwise be caused by the moment created by the resultant downward force on the cantilevered design, tank guide 18 is configured to support at least a portion of resultant downward force F. Force F is transmitted by bottom plate 38 to wheel 36 that is attached to forward bracket 44 and ultimately to undercarriage 20 of tank 14, thus distributing the forces accordingly.

It should be understood that the embodiment depicted herein is merely one embodiment that may be used for effecting the general invention of a docking station and tank guide system for detachably coupling a drive to a mixer in a portable tank. Furthermore, while various elements of the system are beneficial for a ease of use and/or ergonomic considerations, embodiments may be provided without such features. For example, wheels 40 on bottom plate 38 and flared side portions 64 of guide rails 42 for ease of mating the tank guide with the docking station may be omitted or the general functions provided by different elements; the foot pedal type latch release 30 (and mating latch components altogether) may be optional for some applications or may comprise any type of structure; and the linkage that translates the forward motion of the tank into the upward motion of the mixer coupling may be unnecessary in some applications or its function performed by a different type of assembly. For example, the latch release and the mating latch components themselves, where desired, may comprise any types of structures known in the art. The motion for mating the first part of the coupling with the second part may be effected by any type of mechanism known in the art, such as by pulling a lever or pressing a button to initiate an automatic electrical or hydraulic system, for example. In other embodiments, such as for a side-mounted mixer, the aligning the two portions of the drive coupling may not require such a complicated motion. Also, the tank guide may include any number of features for facilitating connection to the docking station, and is not limited to the features shown. Furthermore, such features may not be necessary at all in some embodiments.

Although depicted in the figures with a single tank and a single docking station, one benefit of the present invention is that a process may use fewer docking stations than tanks, thereby saving the capital investment previously associated with attaching a drive to each mixer. For example, a single docking station may serve a plurality of portable tanks, such as for example may be used in a batch process for making pharmaceutical compositions. Even in a situation where one docking station serves only a single tank, the system provides advantages by minimizing the number of components provided underneath the portable tank. For example, removing the drive from among the permanent attachments to the tank may provide access to other components underneath the tank or may facilitate use of other stations to complete other process steps. Decoupling the motor from the tank also means that the tank no longer requires electrical connections to run the motor and any of the attendant considerations that follow from having to periodically hook electricity to a portable tank. While the system depicted in the figures is unique in that it uses only the forward motion of the tank to activate the coupling system rather than using any electrical, pneumatic, or hydraulic components, other systems may be devised that use such components. Also, although tank 14 is depicted having wheels and may be adapted to be moved by an operator pushing the tank, the tank may be mounted on any type of frame, including a pallet, and moved by any means known in the art, such as but not limited to via conveyor belt or fork truck.

Although the tank guide is described herein as a separate component for attaching to a portable tank, and may be provided either as a retrofit on an existing tank, or on original equipment, the portable tank itself may comprise integral components for facilitating mating with the docking station. Thus, in some portable tank embodiments, there may be no discrete tank guide, but merely components that may facilitate and/or maintain engagement with a docking station. Such components may include the portion of a latch for mating with the docking station latch, the flange defining a funnel-shaped passageway for facilitating mating the corresponding portions of the mixer drive coupling, and/or flared guide rails for receiving a portion of the docking station, as described above. It should be understood that as used throughout the specification and claims, the term "tank guide" corresponds to both a discrete assembly for attaching to a tank, or one or more components integrally attached to a tank for performing the functions described above for the tank guide. Similarly, it should be understood that language in the specification or claims referring to the "portable tank" being engaged by docking station refers to engagement of any portion of the tank, its undercarriage, or any assemblies connected to the tank or the undercarriage, such as a discrete tank guide or integral components.

The scope of the invention includes complete systems comprising docking stations and portable tanks designed for use with one another, with or without discrete tank guides, as well as docking stations, discrete tank guides, and/or potable tanks having features for mating with a docking station, sold separately. The scope of the invention also includes a batch process for making a composition using at least one docking station and one or more portable tanks adapted to mate with the docking station. Such a process includes a step of manufacturing the composition, or an intermediate ingredient of the composition, in at least one of the portable tanks, by moving the portable tank to the docking station, engaging the tank, coupling the mixer to the drive, and using the mixer to perform one or more mixing steps in the process.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A system for detachably coupling a mixer drive to a mixer in a portable tank, the system comprising:

a portable tank having a mixer mounted in the tank, the mixer comprising a coupling having a first portion attached to a shaft for driving the mixer; and a fixed docking station adapted to receive the portable tank in an engaged configuration and to have no connection to the portable tank in a disengaged configuration, the docking station comprising a mixer drive having a second portion of the coupling for mating with the first portion;

wherein the docking station comprises a linkage for converting engagement motion transmitted by the tank in a first direction into engagement motion of the coupling second portion in a second direction.

2. The system of claim 1, wherein the mixer comprises a bottom-mount mixer.

3. The system of claim 1, wherein the coupling comprises a magnetic coupling.

4. The system of claim 1, wherein the docking station linkage comprises:

one or more linkage arms having the mixer drive pivotably attached at a first end of the one or more arms, a tank engagement member pivotably attached to an intermediate portion of the linkage arms, one or more biasing members pivotably attached at one end to the intermediate portion of the linkage arms and spaced apart from the tank engagement member for providing resistance to the engagement motion, the one or more biasing members having an opposite end pivotably attached to the support frame, and a slider assembly pivotably attached to a second end of the one or more arms, the linkage adapted to slide in the first direction along the slider assembly and to simultaneously rotate about an axis at or near the second end of the linkage to urge the first end of the linkage in the second direction toward the second portion of the coupling during transition from the disengaged configuration to the engaged configuration.

5. The system of claim 4, wherein the docking station linkage comprises two arms having a plurality of pivot shafts connected between the arms, a mixer drive pivot shaft for pivotably attaching the mixer drive to the linkage arms, a tank engaging member pivot shaft for pivotably attaching the tank engaging member to the linkage arms, a biasing member pivot shaft for pivotably attaching the one or more biasing members to the linkage arms, and a slider assembly pivot shaft for pivotably attaching the slider assembly to the linkage arms, the pivot shaft comprising the axis about which the linkage arms rotate.

6. The system of claim 5, wherein the one of more biasing members comprises a pair of gas springs.

7. The system of claim 5, further comprising spring biasing members mounted on the mixer drive pivot shaft and the tank engaging member pivot shaft for providing spring resistance to pivotal motion of the mixer drive and the tank engaging member.

8. The system of claim 1, wherein in the engaged configuration the linkage is adapted to transmit a resultant downward force on the docking station and the tank comprises a member for receiving at least a portion of the resultant downward force.

9. The system of claim 8, wherein the docking station comprises a cantilevered structure.

10. The system of claim 1 further comprising a latch mechanism for preventing relative motion between the portable tank and the docking station with the system in the engaged configuration, the docking station comprising a first portion of the latch mechanism, the portable tank comprising a second portion of the latch mechanism for mating with the first portion, and the latch mechanism comprising a release mechanism for disengaging the latch mechanism.

11. The system of claim 1, wherein the portable tank comprises one or more components for facilitating engagement of the portable tank with the docking station.

12. The system of claim 1 comprising a single docking station and a plurality of portable tanks.

13. A system for detachably coupling a mixer drive to a mixer in a portable tank, the system comprising:

a portable tank having a mixer mounted in the tank, the mixer comprising a coupling having a first portion attached to a shaft for driving the mixer; and a fixed docking station adapted to receive the portable tank in an engaged configuration and to have no connection to the portable tank in a disengaged configuration, the docking station comprising a mixer drive having a second portion of the coupling for mating with the first portion;

a latch mechanism for preventing relative motion between the portable tank and the docking station with the system in the engaged configuration, the docking station comprising a first portion of the latch mechanism, the portable tank comprising a second portion of the latch mechanism for mating with the first portion, and the latch mechanism comprising a release mechanism for disengaging the latch mechanism, wherein the first portion of the latch mechanism comprises a receiving port, the second portion of the latch mechanism comprises a tongue adapted to fit in the receiving port, and the release mechanism comprises a lever for lifting the tongue out of the receiving port.

14. The system of claim 13, wherein the latch comprises a latch assembly comprising a latch pivot shaft, a latch plate pivotably attached to the pivot shaft, the latch tongue at a first end of the latch plate, and the release lever at a second end of the latch plate, the latch plate connected to a biasing member that urges rotation of the latch plate about the pivot shaft in a direction that biases the latch tongue into the receiving port in the engaged configuration.

15. The system of claim 14, wherein the latch assembly further comprises a stop rod for limiting rotation of the latch plate as biased by the biasing member in the disengaged configuration.

16. A system for detachably coupling a mixer drive to a mixer in a portable tank, the system comprising:

a portable tank having a mixer mounted in the tank, the mixer comprising a coupling having a first portion attached to a shaft for driving the mixer; and a fixed docking station adapted to receive the portable tank in an engaged configuration and to have no connection to the portable tank in a disengaged configuration, the docking station comprising a mixer drive having a second portion of the coupling for mating with the first portion;

wherein the portable tank comprises one or more components for facilitating engagement of the portable tank with the docking station, the one or more components comprising a pair of guide rails adapted to receive a portion of the docking station between the guide rails in the engaged configuration, the guide rails having a flared configuration relative to one another at a forward end of the guide rails to facilitate receipt of the portion of the docking station.

17. The system of claim 16, wherein the docking station comprises a bottom plate adapted in the engaged configuration to be positioned between the pair of guide rails, the bottom plate comprising a plurality of wheels for facilitating positioning of the bottom plate between the guide rails.

18. The system of claim 17 further comprising a wheel mounted on a shaft between the guide rails, the wheel positioned to contact an underside of the docking station bottom plate in the engaged configuration.

19. A docking station component of a system for detachably coupling a mixer drive to a mixer in a portable tank, the system comprising a portable tank and a fixed docking station adapted to receive the portable tank in an engaged configuration and to have no connection to the portable tank in a disengaged configuration, the portable tank comprising a mixer mounted in the tank, the mixer comprising a coupling having a first portion attached to a shaft for driving the mixer, the docking station component comprising:

a mixer drive having a second portion of the coupling for mating with the first portion a support frame;

a linkage attached to the support frame for converting engagement motion transmitted by the tank in a first direction into engagement motion of the coupling second portion in a second direction; and a first portion of a latch mechanism for preventing relative motion between the tank and the docking station with the system in the engaged configuration, the first portion adapted to mate with a second portion attached to the tank.

20. The docking station of claim 19, wherein the linkage comprises:

one or more linkage arms having the mixer drive pivotably attached at a first end of the one or more arms, a tank engagement member pivotably attached to an intermediate portion of the linkage arms, one or more biasing members pivotably attached at one end to the intermediate portion of the linkage arms and spaced apart from the tank engagement member for providing resistance to the engagement motion, the one or more biasing members having an opposite end pivotably attached to the support frame, and a slider assembly pivotably attached to a second end of the one or more arms, the linkage adapted to slide in the first direction along the slider assembly and to simultaneously rotate about an axis at or near the second end of the linkage to urge the first end of the linkage in the second direction toward the second portion of the coupling.

21. The docking section of claim 20, wherein the linkage comprises two arms having a plurality of pivot shafts connected between the arms, a mixer drive pivot shaft for pivotably attaching the mixer drive to the linkage arms, a tank engaging member pivot shaft for pivotably attaching the tank engaging member to the linkage arms, a biasing member pivot shaft for pivotably attaching the one or more biasing members to the linkage arms, and a slider assembly pivot shaft for pivotably attaching the slider assembly to the linkage arms, the pivot shaft comprising the axis about which the linkage arms rotate.

22. The docking station of claim 21, wherein the one of more biasing members comprises a pair of gas springs.

23. The docking station of claim 21, further comprising spring biasing members mounted on mixer drive pivot shaft and the tank engaging member pivot shaft for providing spring resistance to pivotal motion of the mixer drive and the tank engaging member.

24. The docking station of claim 19, wherein the docking station comprises a cantilevered structure.

25. A docking station component of a system for detachably coupling a mixer drive to a mixer in a portable tank, the system comprising a portable tank and a fixed docking station adapted to receive the portable tank in an engaged configuration and to have no connection to the portable tank in a disengaged configuration, the portable tank comprising a mixer mounted in the tank, the mixer comprising a coupling having a first portion attached to a shaft for driving the mixer, the docking station component comprising:

a mixer drive having a second portion of the coupling for mating with the first portion; and a bottom plate adapted in the engaged configuration to be positioned between guide rails on the portable tank, the bottom plate comprising a plurality of wheels for facilitating positioning of the bottom plate between the guide rails.

26. A tank guide component of a system for detachably coupling a mixer drive to a mixer in a portable tank, the system comprising a portable tank having a mixer mounted in the tank, the mixer comprising a coupling having a first portion attached to a shaft for driving the mixer and a fixed docking station adapted to receive the portable tank in an engaged configuration and to have no connection to the portable tank in a disengaged configuration, the tank guide comprising:

a support frame for connection to the portable tank;

one or more components for facilitating and/or maintaining engagement of the portable tank with the docking station, the one or more components comprising a second portion of a latch mechanism for preventing relative motion between the tank guide and the docking station in the engaged configuration, the second portion adapted to mate with a first portion attached to the docking station and having a tongue adapted to fit in a receiving port comprising the first portion of the latch mechanism, the latch mechanism further comprising a release lever for lifting the tongue out of the receiving port.

27. The tank guide of claim 26, wherein the latch comprises a latch assembly comprising a latch pivot shaft attached to the tank guide frame, a latch plate pivotably attached to the pivot shaft, the latch tongue at a first end of the latch plate, and the release lever at a second end of the latch plate, the latch plate connected to the tank guide frame via a biasing member that urges rotation of the latch plate about the pivot shaft in a direction that biases the latch tongue into the receiving port in the engaged configuration.

28. The tank guide of claim 27, wherein the latch assembly further comprises a stop rod attached to the tank guide frame for limiting rotation of the latch plate as biased by the biasing member in the disengaged configuration.

29. A tank guide component of a system for detachably coupling a mixer drive to a mixer in a portable tank, the system comprising a portable tank having a mixer mounted in the tank, the mixer comprising a coupling having a first portion attached to a shaft for driving the mixer and a fixed docking station adapted to receive the portable tank in an engaged configuration and to have no connection to the portable tank in a disengaged configuration, the tank guide comprising:

a support frame for connection to the portable tank;

one or more components for facilitating and/or maintaining engagement of the portable tank with the docking station, the one or more components comprising a pair of guide rails adapted to receive a portion of the docking station between the guide rails in the engaged configuration, the guide rails having a flared configuration relative to one another at a forward end of the guide rails to facilitate receipt of the portion of the docking station.

30. The tank guide of claim 29, further comprising a wheel mounted on a shaft between the guide rails, the wheel positioned to contact an underside of the portion of the docking station adapted to be received between the guide rails.

31. The tank guide of claim 30, wherein the wheel positioned to contact with the underside of docking station is adapted to receive at least a portion of a resultant downward force transmitted by the docking station in the engaged configuration.

32. A batch manufacturing process for manufacturing a composition, the process comprising:

(a) providing one or more portable tanks, each tank having a mixer mounted in the tank, each mixer comprising a coupling having a first portion attached to a shaft for driving the mixer;

(b) providing at least one fixed docking station adapted to receive the one or more portable tanks in an engaged configuration and to have no connection to the portable tank in a disengaged configuration, the docking station comprising a mixer drive having a second portion of the coupling for mating with the first portion;

(c) manufacturing a batch of the composition or an intermediate ingredient required for making the composition in each of the portable tanks, comprising performing one or more mixing steps by moving the portable tank to and engaging the tank with the docking station by moving the tank in a first direction in contact with a portion of a linkage in the docking station such that the linkage converts the tank motion into engagement motion of the coupling second portion in a second direction to connect with the first portion of the coupling, connecting the first and second portions of the mixer coupling together, and driving the mixer in the portable tank using the mixer drive on the docking station.

33. The process of claim 32, comprising providing each tank with a bottom-mount mixer and providing a magnetic coupling for the mixer drive and the mixer.

34. The process of claim 32, comprising providing a latch mechanism for preventing relative motion between the tank and the docking station in the engaged configuration, the docking station comprising a first portion of the latch mechanism, and each portable tank comprising a second portion of the latch mechanism for mating with the first portion, the process comprising in step (c), engaging the latch mechanism to maintain engagement of the tank with the docking station, and after step (c) disengaging the latch mechanism by operating a latch release mechanism.

35. A portable tank having a mixer mounted in the tank, the mixer comprising a coupling having a first portion attached to a shaft for driving the mixer, the tank adapted for docking with a fixed docking station in an engaged configuration and to have no connection to the docking station in a disengaged configuration, the docking station comprising a mixer drive comprising a second portion of the coupling that mates with the first part of the coupling, the portable tank comprising one or more components for facilitating and/or maintaining engagement of portable tank with the docking station, the one or more components comprising a second portion of a latch mechanism for preventing relative motion between the tank and the docking station with the system in the engaged configuration, the second portion adapted to mate with a first portion attached to the docking station and having a tongue adapted to fit in a receiving port comprising the first portion of the latch mechanism, the latch mechanism further comprising a release lever for lifting the tongue out of the receiving port.

36. The portable tank of claim 35, wherein the latch comprises a latch assembly comprising a latch pivot shaft, a latch plate pivotably attached to the pivot shaft, the latch tongue at a first end of the latch plate, and the release lever at a second end of the latch plate, the latch plate biased by a biasing member that urges rotation of the latch plate about the pivot shaft in a direction that biases the latch tongue into the receiving port in the engaged configuration.

37. The portable tank of claim 36, wherein the latch assembly further comprises a stop rod for limiting rotation of the latch plate as biased by the biasing member in the disengaged configuration.

38. The portable tank of claim 35, wherein one component for facilitating engagement of the portable tank with the docking station comprises a flange defining a funnel-like passageway leading to the first portion of the coupling for facilitating mating the second portion of the coupling to the first portion.

39. A portable tank having a mixer mounted in the tank, the mixer comprising a coupling having a first portion attached to a shaft for driving the mixer, the tank adapted for docking with a fixed docking station in an engaged configuration and to have no connection to the docking station in a disengaged configuration, the docking station comprising a mixer drive comprising a second portion of the coupling that mates with the first part of the coupling, the portable tank comprising one or more components for facilitating and/or maintaining engagement of portable tank with the docking station, the one or more components comprising a pair of guide rails adapted to receive a portion of the docking station between the guide rails in the engaged configuration, the guide rails having a flared configuration relative to one another at a forward end of the guide rails to facilitate receipt of the portion of the docking station.

40. The portable tank of claim 39, further comprising a wheel mounted on a shaft between the guide rails, the wheel positioned to contact an underside of the portion of the docking station adapted to be received between the guide rails.

41. The portable tank of claim 40, wherein the wheel positioned to contact with the underside of docking station is adapted to receive at least a portion of a resultant downward force transmitted by the docking station in the engaged configuration.

42. The portable tank of claim 39, wherein one component for facilitating engagement of the portable tank with the docking station comprises a flange defining a funnel-like passageway leading to the first portion of the coupling for facilitating mating the second portion of the coupling to the first portion.

43. A system for detachably coupling a mixer drive to a mixer in a portable tank, the system comprising:

a portable tank having a mixer mounted inside the tank and a pair of guide rails for facilitating engagement of the portable tank with a docking station, the mixer comprising a magnetic coupling having a first portion attached to a shaft for driving the mixer, the pair of guide rails having a configuration relative to one another at a forward end of the guide rails to facilitate receipt of an extension of the docking station;

a docking station adapted to receive the portable tank in an engaged configuration and to have no connection to the portable tank in a disengaged configuration, the docking station comprising a mixer drive having a second portion of the magnetic coupling for mating with the first portion, a linkage for converting engagement motion transmitted by the tank in a first direction into engagement motion of the coupling second portion in a second direction, and the extension adapted to be received between the portable tank guide rails; and a latch mechanism for preventing relative motion between the portable tank and the docking station with the system in the engaged configuration, the docking station comprising a first portion of the latch mechanism, the portable tank comprising a second portion of the latch mechanism for mating with the first portion, and the latch mechanism comprising a release mechanism for disengaging the latch mechanism.

* * * * *